US005585992A

United States Patent [19]

Wu

[11] Patent Number: 5,585,992

[45] Date of Patent: Dec. 17, 1996

[54] LEAKAGE PROTECTOR

[76] Inventor: Wen S. Wu, P.O. Box 82-144, Taipei, Taiwan

[21] Appl. No.: 412,712

[22] Filed: Mar. 28, 1995

[51] Int. Cl.[6] ..... H02H 3/16

[52] U.S. Cl. ..... 361/45; 361/49

[58] Field of Search ..... 361/45, 49, 50, 361/115; 307/116

[56] References Cited

U.S. PATENT DOCUMENTS 4,587,588 5/1986 Goldstein ..... 361/54

5,019,935 5/1991 Nakamura ..... 361/45

5,305,173 4/1994 Kakuta et al. ..... 361/45

*Primary Examiner*—Todd DeBoer

*Attorney, Agent, or Firm*—Alfred Lei

[57] ABSTRACT

A leakage protector comprising a lower and upper cover containing a control circuit which includes a bridge rectifier, a pulse absorber, a light-emitting diode, a comparator, a SCR and a relay wherein the output of the comparator causes the relay to interrupt power to a load.

1 Claim, 7 Drawing Sheets

LEAKAGE PROTECTOR

BACKGROUND OF THE INVENTION

1. Field of the Invention

This invention relates to a leakage protector which will automatically interrupt the flow of an electric current as when there is current leakage.

2. Description of the Prior Art

It has been found that none of electrical household appliances on the market is provided with a device which can automatically interrupt the flow of an electric current as when there is a current leakage. Hence, once current leakage happens, a disaster may be arisen.

Therefore, it is an object of the present invention to provide a leakage protector which can obviate and mitigate the above-mentioned drawbacks.

SUMMARY OF THE INVENTION

This invention relates to a leakage protector.

It is the primary object of the present invention to provide a leakage protector which will automatically interrupt the flow of an electric current as when there is a current leakage.

It is another object of the present invention to provide a leakage protector which can ensure the safety of the user.

It is still another object of the present invention to provide a leakage protector which is simple in construction.

It is still another object of the present invention to provide a leakage protector which is practical in use.

It is a further object of the present invention to provide a leakage protector which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
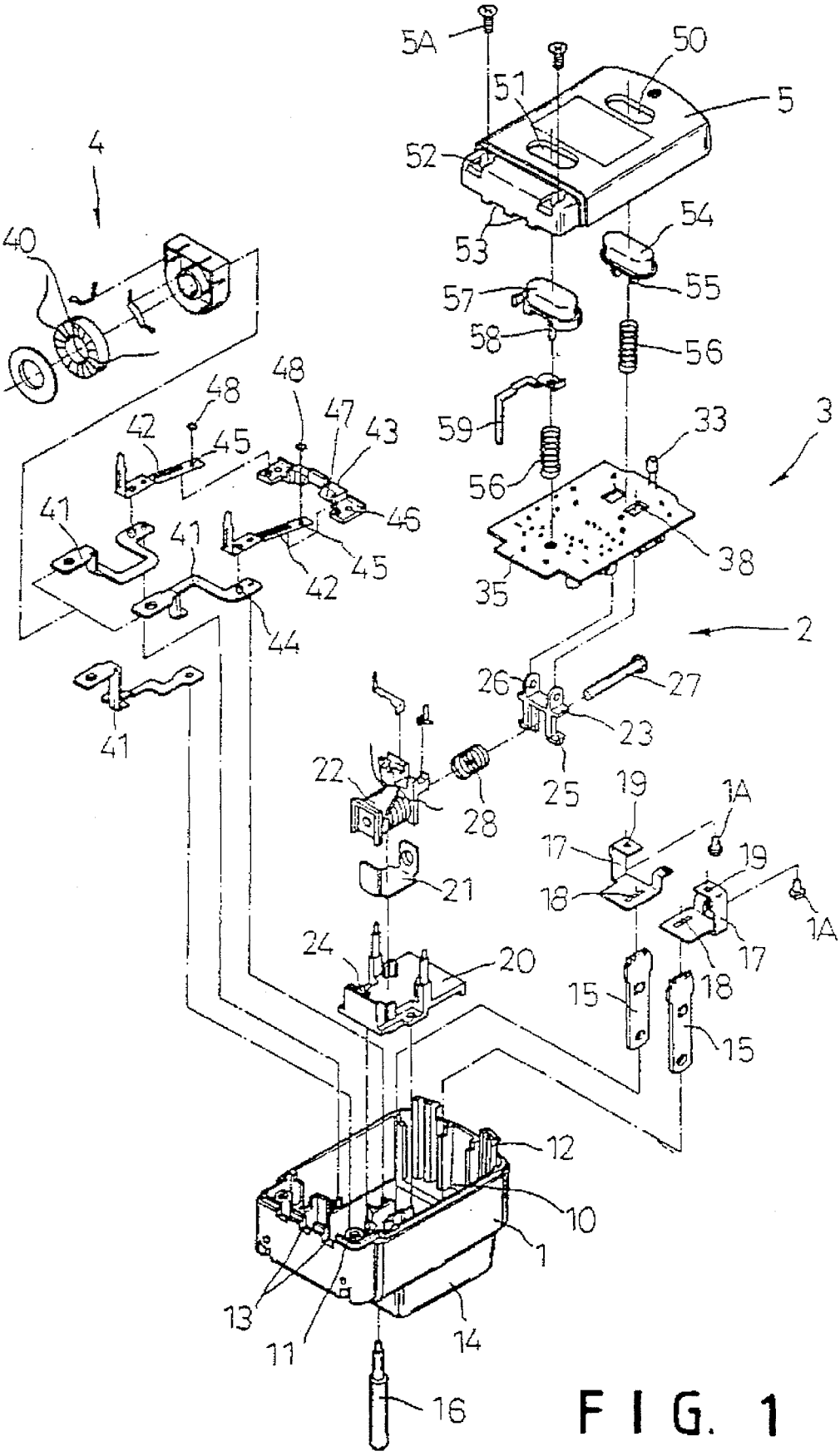
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
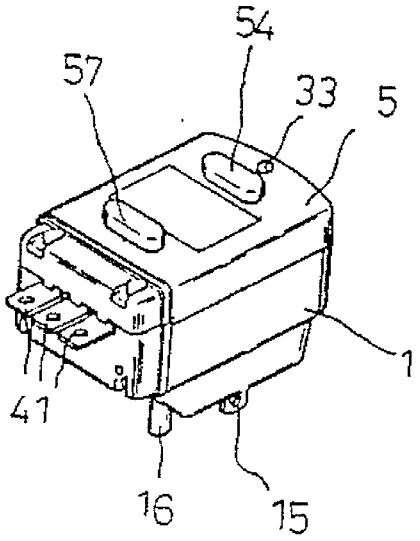
FIG. 2 is a perspective view of the present invention.
Figure 4:
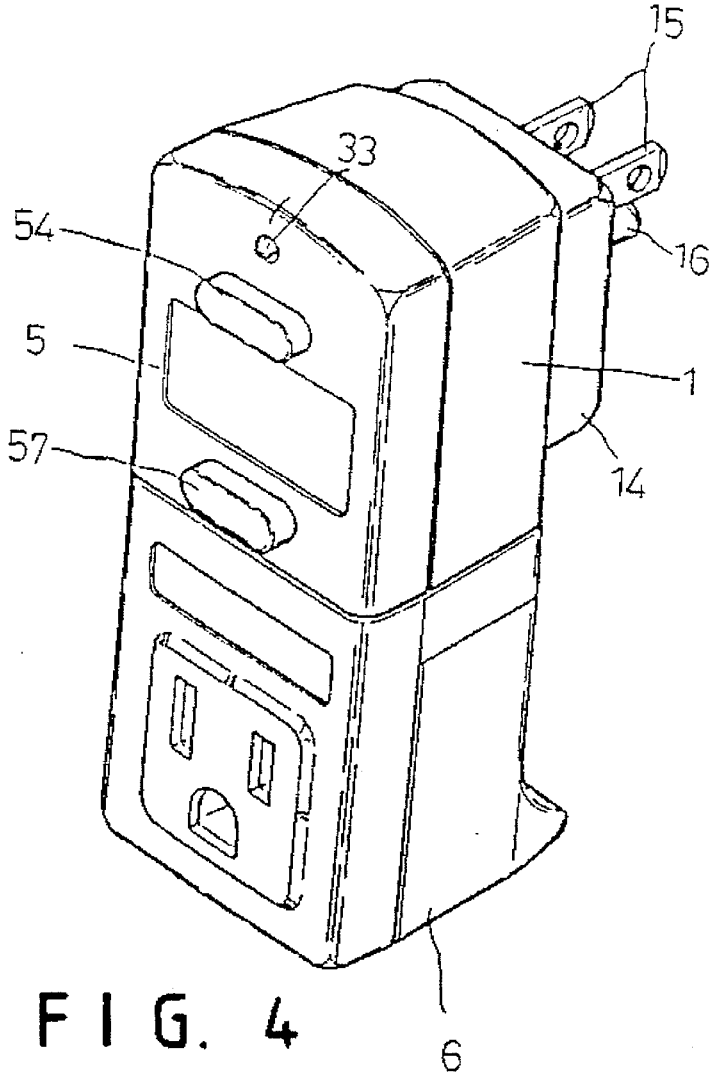
FIG. 4 is a perspective view of the present invention.

With reference to the drawings and in particular to FIGS. 1 and 2 thereof, the leakage protector according to the present invention mainly comprises a lower cover 1, a conducting device 2, a control device 3, a load device 4, and an upper cover 5.

The lower cover 1 includes a recess 10, two internally threaded tubular sleeves 11 at the front side, two engaging portions 12 at the other side, and two notches 13 at the upper edge of the front side. The lower portion 14 of the lower cover 1 is formed with slots (not shown) for receiving prongs 15 and 16. The upper end of the prongs 15 is engaged with a slit 18 of a fixing seat 17. The fixing seat 17 is provided at the top with a hole 19 adapted to receive a first silver contact member 1A.

The conducting device 2 includes a positioning seat 20, a frame 21, a coil 22, and a mounting 23. The positioning seat 20 is provided with two holding arms 24 in which is fitted the frame 21. The coil 22 is mounted on the frame 21 which is in turn installed on the positioning seat 20. The mounting 23 is provided with two feet 25 at the lower portion and two lugs 26 at the upper portion. A spring 28 is disposed between the coil 22 and the mounting 23. A shaft 27 extends through the mounting 23 and the spring 28 to engage the coil 22.

Figure 3:
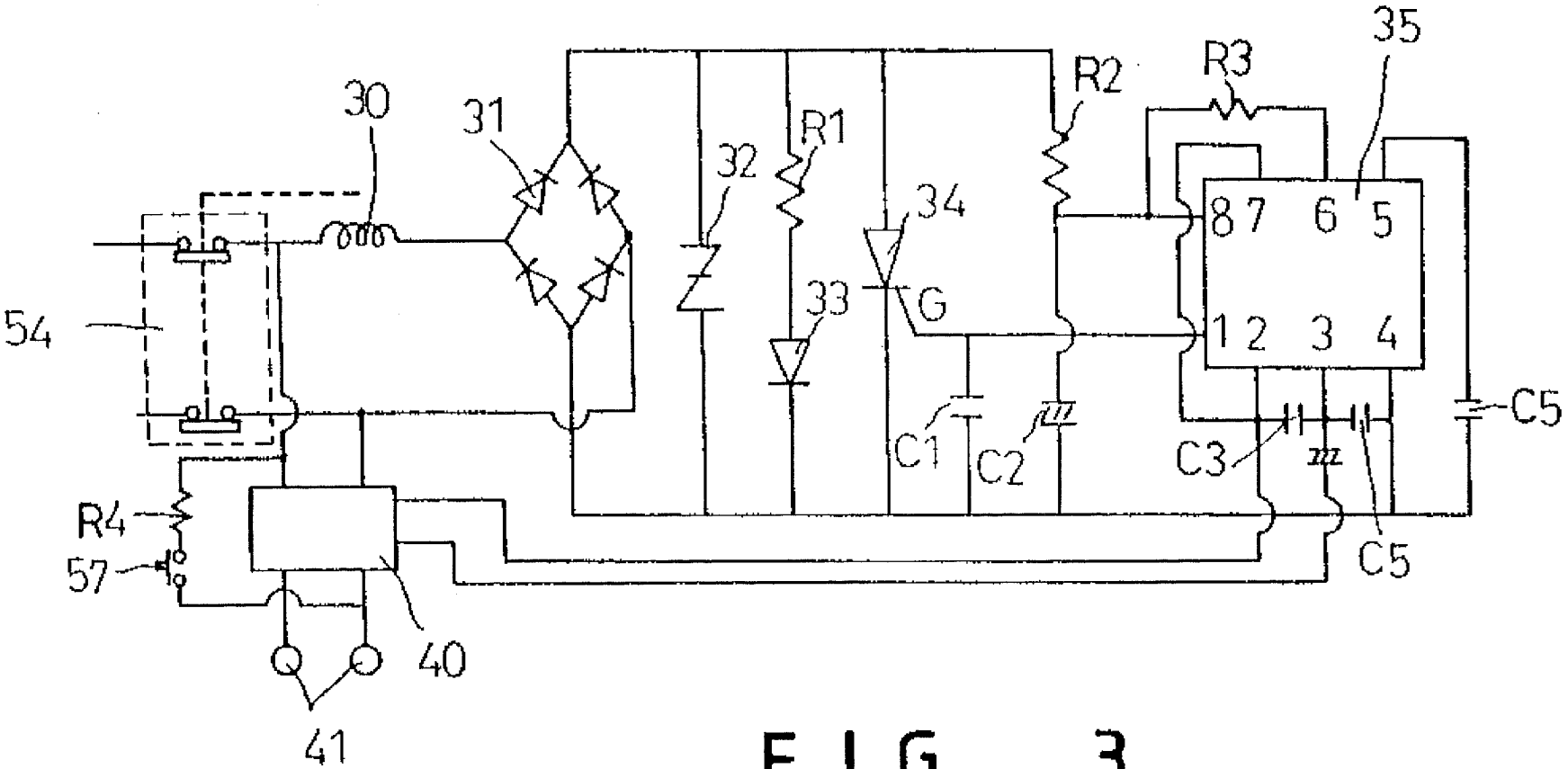
FIG. 3 shows the electrical circuit of the present invention.
Figure 5:
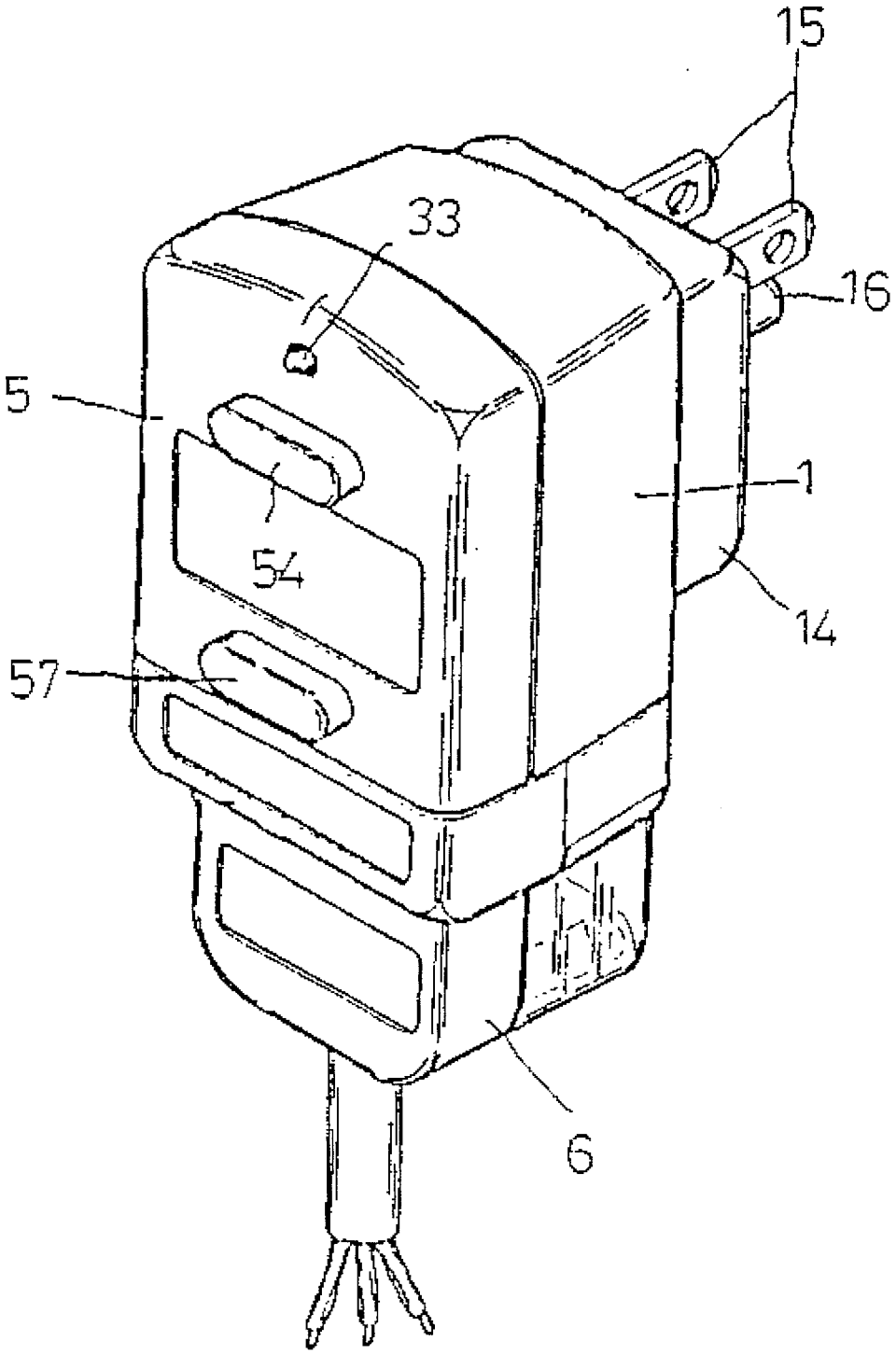
FIG. 5 is another perspective view of the present invention.
Figure 6B:
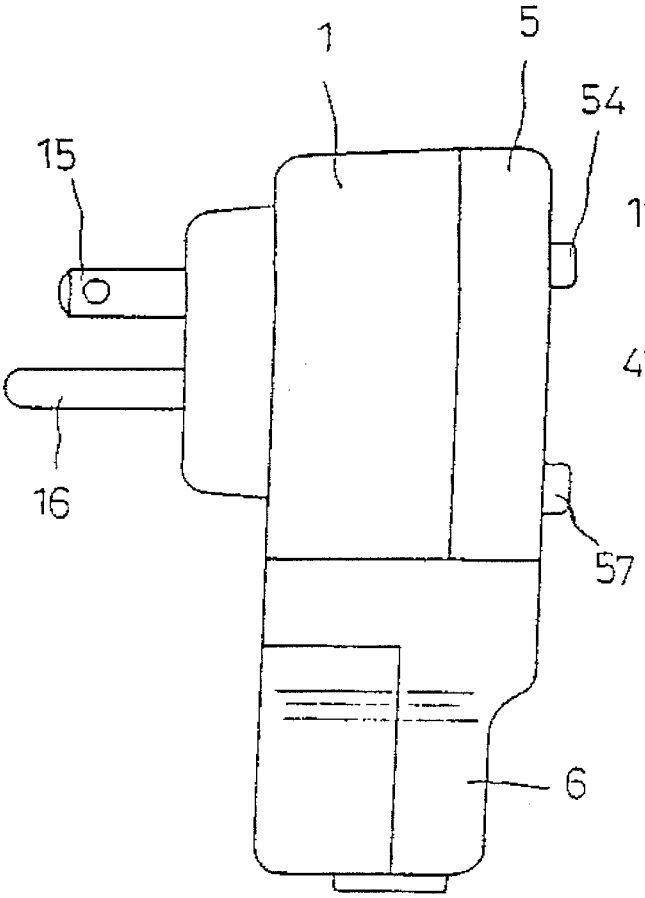
FIG. 6B is a side view of the present invention.
Figure 6A:
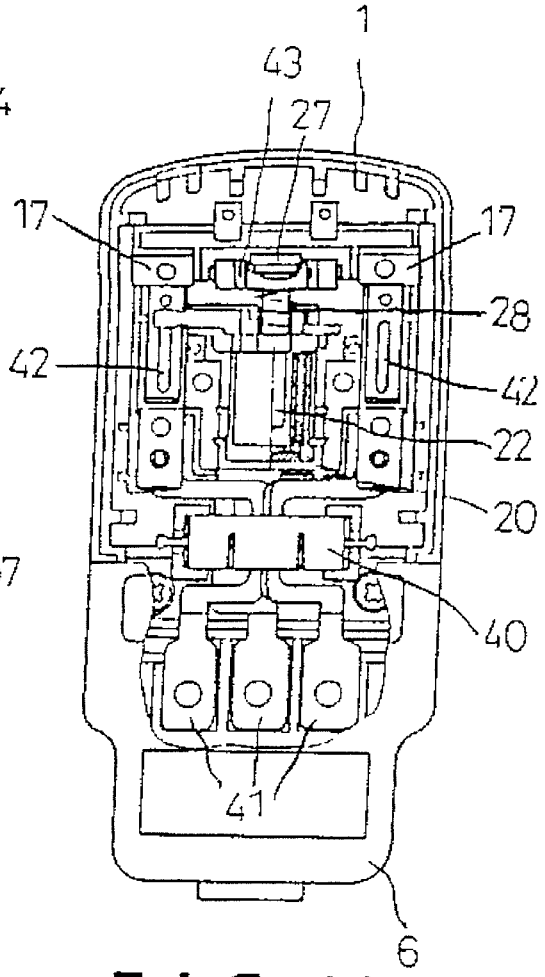
FIG. 6A is a top view of the present invention, with the cover removed.
Figure 7A:
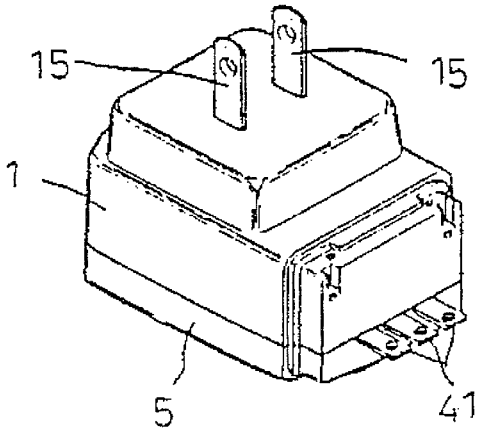
FIGS. 7A, 7B and 7C show different embodiments of the present invention.
Figure 7B:
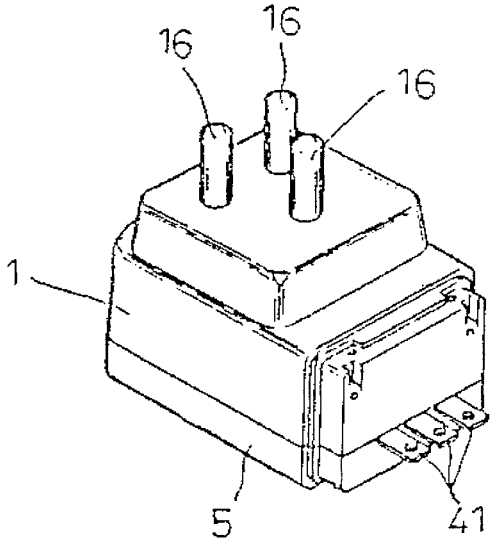
Figure 7C:
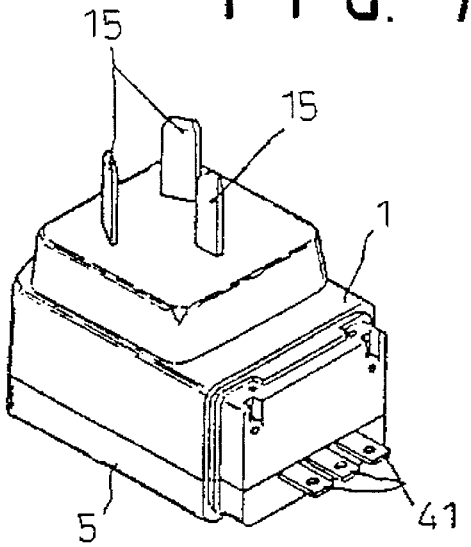
Figure 8A:
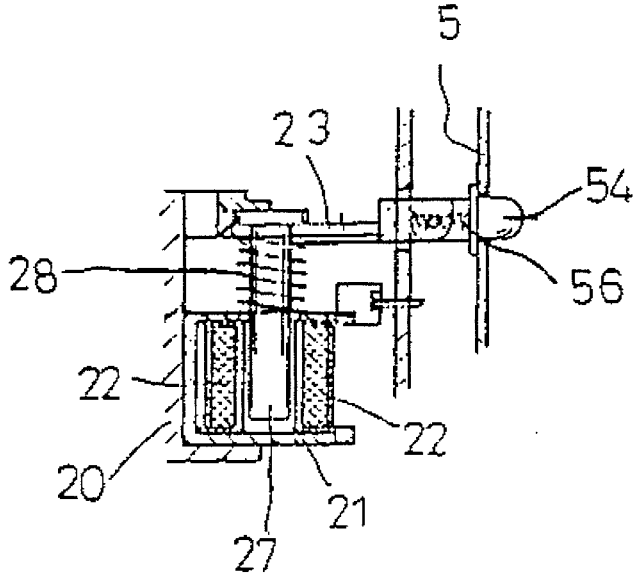
FIG. 8A, 8B shows he working principle of the present invention.
Figure 8B:
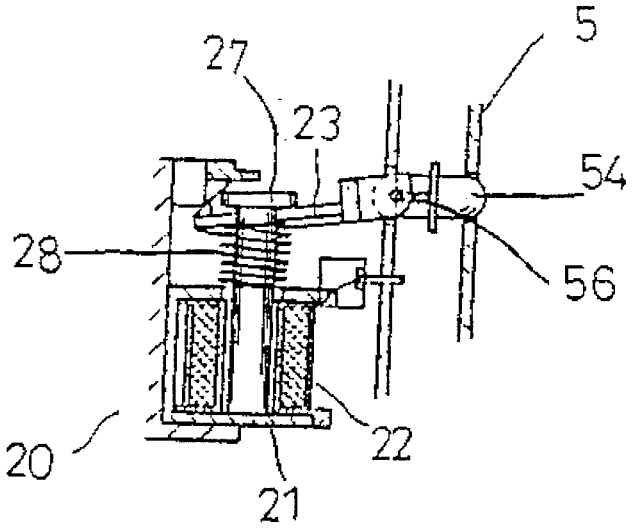

The control device 3 includes a relay 30, a bridge rectifier 31, a pulse absorber 32, a light-emitting diode 33, a silicon controlled rectifier 34, an IC circuit board 35, resistors R1–R4, and capacitors C1–C5 (see FIG. 3). On the IC circuit board 35 there are two holes 38 through protrude the lugs 26 of the mount 23.

The load device 4 includes a current comparator 40, a pair of load terminals 41, a pair of conducting plates 42, and a connecting member 43. The current comparator 40 is used to compare the current flowing through the input terminal and the current flowing through the output terminal so as to detect if there is an electricity leakage or not. The load terminal 41 is provided with a protuberance 44 adapted to contact the conducting plate 42. The conducting plate 42 has a hole 45 at an end. The connecting member 43 is formed with an engaging portion 47 and a hole 46 at both ends. The hole 45 of the conducting plate 42 is aligned with the hole 46 of the connecting member 43. A second silver contact member 48 is fitted into the holes 45 and 46.

The upper cover 5 is formed with a first opening 50 engaged with a recovery button 54, a second opening 51 engaged with a test button 57, two fixing holes 52, and two recesses 53. The recovery button 54 is provided at the bottom with two pins 55 engaged with a spring 56. The test button 57 has a rod portion 58 engaged with a conducting member 59 and a spring 56. The fixing holes 52 of the upper cover 5 are aligned with the two tubular sleeves 11 of the lower cover 1 and the upper cover 5 is engaged with the lower cover 1 by screws 5A.

When the present invention is connected with a power supply, the power supply will cause the light emitting diode 33 to give off light while there is current through a relay 30, a bridge rectifier 3 and a resistor R1. In normal condition, the input current to the current comparator 40 is just equal to the output current from the current comparator 40. However, when there is leakage at the load terminal 41, the input current to the current comparator 40 will not be equal to the output current. Meanwhile, the comparator 40 will send out signal to the IC circuit board 35 which will in turn make the relay 30 interrupt through the silicon controlled rectifier 34 and the conducting device 2. Hence, no more power will be supplied to the load terminal 41 thereby ensuring safety. Further, the electrical circuit can be recovered by pressing the recovery button 54.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A leakage protector comprising:

a lower cover including a recess, two internally threaded tubular sleeves at an inner side, two engaging portions at an opposite inner side, and two notches at an upper edge of said inner side, said lower cover being provided with prongs having an upper end engaged with a slit of a fixing seat, said fixing seat being provided at a top with a hole adapted received a silver contact member;

an upper cover adapted to engaged with said lower cover, said upper cover being formed with a first opening in which is fitted a recovery button, a second opening in which is fitted a test button, and a third opening;

conducting means mounted in said lower cover, said conducting means including a positioning seat, a frame, a coil and a mounting, a spring and a shaft, said positioning seat being provided with two holding arms in which is fitted said frame, said coil being mounted on said frame, said mounting being provided with two feet at a lower portion thereof and two lugs at an upper thereof, said spring being disposed between said coil and said mounting, said shaft extending through said mounting and said spring to engage with said coil;

load means including a comparator and a relay electrically connected with said comparator; and control means electrically connected with said conducting means and said load means and including a bridge rectifier, a pulse absorber and a light-emitting diode, said light-emitting diode giving off light while there is current through said relay, said bridge and said resistors when said leakage protector is connected with a power supply and input current to said comparator is equal to output current from said comparator indicating a normal condition, said comparator responsive to said input current not being equal to said output current to send out a signal to said IC circuit board which will in turn cause said relay to interrupt through operation of said silicon controlled rectifier, said light-emitting diode being fitted in said third opening of said upper cover.

* * * * *